US010278487B2

(12) United States Patent
Wu et al.

(10) Patent No.: US 10,278,487 B2
(45) Date of Patent: May 7, 2019

(54) ORAL CARE IMPLEMENTS AND METHODS OF MANUFACTURING THE SAME

(71) Applicant: COLGATE-PALMOLIVE COMPANY, New York, NY (US)

(72) Inventors: Donghui Wu, Bridgewater, NJ (US); Alan Sorrentino, Cranbury, NJ (US); Robert Moskovich, East Brunswick, NJ (US); Eduardo Jimenez, Manalapan, NJ (US); Kenneth Waguespack, North Brunswick, NJ (US); Douglas Joseph Hohlbein, Hopewell, NJ (US); Matthew Lee Kolb, Upper Black Eddy, PA (US); Paul Donald Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 102 days.

(21) Appl. No.: 15/309,187

(22) PCT Filed: May 7, 2014

(86) PCT No.: PCT/US2014/037135
§ 371 (c)(1),
(2) Date: Nov. 6, 2016

(87) PCT Pub. No.: WO2015/171129
PCT Pub. Date: Nov. 12, 2015

(65) Prior Publication Data
US 2017/0215570 A1 Aug. 3, 2017

(51) Int. Cl.
*A46B 11/00* (2006.01)
*A46B 9/04* (2006.01)

(52) U.S. Cl.
CPC ..... *A46B 11/0006* (2013.01); *A46B 9/04* (2013.01); *A46B 11/002* (2013.01);
(Continued)

(58) Field of Classification Search
CPC ... A46B 11/0006; A46B 11/0086; A46B 9/04; A46B 5/026; A46B 11/0041;
(Continued)

(56) References Cited

U.S. PATENT DOCUMENTS 2,743,042 A 6/1953 Burgin
2,652,949 A 9/1953 Martin
(Continued)

FOREIGN PATENT DOCUMENTS

CN 201798216 U 4/2011
CN 202950195 U 5/2013
(Continued)

OTHER PUBLICATIONS

International Search Report and the Written Opinion of the International Searching Authority issued in international application PCT/2014/037135 mailed 22 Jan. 2015.

*Primary Examiner* — David Walczak

(57) ABSTRACT

An oral care implement having a body comprising a handle, a head having at least one oral care element extending therefrom, and at least one fluid outlet; a reservoir in the body and for storing an oral care fluid; and a pump in the body for pumping the oral care fluid from the reservoir towards the fluid outlet, wherein the pump is an umbrella check valve circumferentially surrounding a duckbill check valve. Alternatively, the invention is a method of manufacturing an oral care implement, including the steps of providing a body comprising a base having first and second holes extending therethrough; and fitting to the body a unitary component comprising first and second valves at a position at which the first valve blocks the first hole and the second valve blocks the second hole, wherein the first valve is an umbrella check valve that circumferentially surrounds the second valve.

20 Claims, 2 Drawing Sheets

(52) U.S. Cl.
CPC ..... *A46B 11/0041* (2013.01); *A46B 11/0058* (2013.01); *A46B 11/0086* (2013.01); *A46B 2200/1066* (2013.01)

(58) Field of Classification Search
CPC ..... A46B 2200/1066; A46B 11/001; A46B 11/0017; A46B 11/002; A46B 11/0051; A46B 11/0055; A46B 5/02; A46B 5/028; A46B 11/0058
See application file for complete search history.

(56) References Cited

U.S. PATENT DOCUMENTS

| | | | | |
|---|---|---|---|---|
| 3,242,928 | A * | 3/1966 | Peters | A46B 11/0017 132/308 |
| 3,256,894 | A | 6/1966 | Sherman | |
| 3,941,149 | A | 3/1976 | Mittleman | |
| 4,155,663 | A | 5/1979 | Cerquozzi | |
| 4,521,128 | A | 6/1985 | O'Neal | |
| 4,582,075 | A | 4/1986 | O'Neal | |
| 4,963,046 | A | 10/1990 | Eguchi | |
| 5,393,153 | A | 2/1995 | Bouthillier | |
| 5,407,287 | A | 4/1995 | Braun et al. | |
| 5,918,995 | A | 7/1999 | Puurunen | |
| 6,056,466 | A | 5/2000 | Johnson | |
| 6,257,791 | B1 | 7/2001 | Scamard | |
| 6,406,207 | B1 | 6/2002 | Wiegner et al. | |
| 7,004,662 | B1 | 2/2006 | Gordon | |
| 8,087,843 | B2 * | 1/2012 | Ottaviani | A46B 11/0041 15/22.1 |
| 2003/0168475 | A1 | 9/2003 | Heukamp | |
| 2007/0041779 | A1 | 2/2007 | Kuo | |
| 2008/0205970 | A1 * | 8/2008 | LaFlamme | A46B 11/0058 401/205 |
| 2012/0301209 | A1 | 11/2012 | Fattori | |
| 2013/0308994 | A1 | 11/2013 | Wu | |

FOREIGN PATENT DOCUMENTS

| | | |
|---|---|---|
| EP | 0171462 | 3/1986 |
| FR | 2600513 | 12/1987 |
| GB | 913371 | 12/1962 |
| GB | 2290702 | 1/1996 |
| GB | 2291799 | 2/1996 |
| GB | 2329110 | 3/1999 |

* cited by examiner

ORAL CARE IMPLEMENTS AND METHODS OF MANUFACTURING THE SAME

BACKGROUND

The present invention relates to oral care implements, such as toothbrushes, having a pump for pumping an oral care fluid to a fluid outlet, and also to methods of manufacturing such oral care implements.

It is known to provide an oral care implement, such as a toothbrush, with a reservoir storing an oral care fluid that is feedable to a fluid outlet at a head of the implement. One such known oral care implement has a complex pump mechanism including many separate moving parts for driving oral care fluid from a reservoir to a fluid outlet, which makes the implement expensive to manufacture and assemble. Another such known oral care implement has a bulky pump mechanism, which either makes the overall oral care implement bulky, or means there is less space inside the oral care implement for other components, such as a reservoir.

There is a need for an oral care implement having a simpler pump for pumping an oral care fluid to a fluid outlet of the implement. There also is a need for an oral care implement having a more compact pump for supplying an oral care fluid to a fluid outlet of the implement. There further is a need for an easier method of manufacturing an oral care implement having a pump.

BRIEF SUMMARY

An embodiment of the present invention provides a first oral care implement, comprising: a body comprising a handle, a head at an end of the handle, and at least one fluid outlet, the head having at least one oral care element extending therefrom; a reservoir in the body and for storing an oral care fluid; and a pump in the body for pumping the oral care fluid from the reservoir towards the fluid outlet, wherein the pump comprises a first valve downstream of the reservoir, a second valve downstream of the first valve and upstream of the fluid outlet, and one of the first and second valves circumferentially surrounds the other of the first and second valves.

Optionally, one of the first and second valves comprises an umbrella check valve. Further optionally, the first valve comprises the umbrella check valve.

Optionally, the other of the first and second valves comprises one of a diaphragm check valve, a ball check valve, a swing check valve, a duckbill check valve, and an umbrella check valve.

Optionally, each of the first and second valves comprises a check valve.

Another embodiment of the present invention provides a second oral care implement, comprising: a body comprising a handle, a head at an end of the handle, and at least one fluid outlet, the head having at least one oral care element extending therefrom; a reservoir in the body and for storing an oral care fluid; and a pump in the body for pumping the oral care fluid from the reservoir towards the fluid outlet, the pump comprising an umbrella check valve.

Optionally, in the second oral care implement, the pump comprises a first valve downstream of the reservoir, a second valve downstream of the first valve and upstream of the fluid outlet, and one of the first and second valves comprises the umbrella check valve. Further optionally, the other of the first and second valves comprises one of a diaphragm check valve, a ball check valve, a swing check valve, a duckbill check valve, and an umbrella check valve.

Optionally, in the second oral care implement, each of the first and second valves comprises a check valve.

Optionally, in the second oral care implement, one of the first and second valves circumferentially surrounds the other of the first and second valves.

Optionally, either one of the first and second oral care implements comprises a base having first and second holes extending therethrough along respective flow axes, and each of the flow axes is at between 45 and 90 degrees to a longitudinal axis of the oral care implement, and each of the first and second valves selectively blocks a respective one of the first and second holes.

Optionally, each of the flow axes is substantially perpendicular to the longitudinal axis of the oral care implement.

Optionally, each of the flow axes is substantially perpendicular to a lateral axis of the oral care implement.

Optionally, in either one of the first and second oral care implements, the pump comprises a unitary component comprising the first and second valves. Further optionally, the unitary component is formed of a resilient material, such as an elastomeric material, such as an elastomer, a thermoplastic elastomer, or styrene-ethylene/butylene-styrene.

Optionally, in either one of the first and second oral care implements, the pump comprises a chamber of variable volume downstream of the first valve and upstream of the second valve.

Optionally, in either one of the first and second oral care implements, the pump comprises a diaphragm pump. Further optionally, either one of the first and second oral care implement comprises a thumb grip surface on the handle, and the thumb grip surface is unitary with a movable diaphragm of the diaphragm pump.

Optionally, in either one of the first and second oral care implements, the oral care fluid is stored in the reservoir.

Optionally, in either one of the first and second oral care implements, the reservoir is in the handle.

Optionally, in either one of the first and second oral care implements, the reservoir is comprised in the body and forms the handle.

Optionally, in either one of the first and second oral care implements, the reservoir is detachably connected to the body.

Optionally, in either one of the first and second oral care implements, the reservoir is transparent or translucent.

Optionally, in either one of the first and second oral care implements, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof.

Optionally, either one of the first and second oral care implements comprises a toothbrush.

Another embodiment of the present invention provides a first method of manufacturing an oral care implement having a pump, the method comprising: providing a body comprising a base having first and second holes extending therethrough; and fitting to the body a unitary component comprising first and second valves at a position at which the first valve blocks the first hole and the second valve blocks the second hole, wherein one of the first and second valves circumferentially surrounds the other of the first and second valves.

Optionally, one of the first and second valves comprises an umbrella check valve.

Another embodiment of the present invention provides a second method of manufacturing an oral care implement having a pump, the method comprising: providing a body comprising a base having first and second holes extending therethrough; and fitting to the body a unitary component comprising first and second valves at a position at which the first valve blocks the first hole and the second valve blocks the second hole, wherein one of the first and second valves comprises an umbrella check valve.

Optionally, in the second method, one of the first and second valves circumferentially surrounds the other of the first and second valves.

Optionally, in either one of the first and second methods, the fitting comprises press-fitting the unitary component to the body. Further optionally, the fitting comprises press-fitting the second valve in the second hole at a position at which the first valve blocks the first hole and the second valve blocks the second hole.

Optionally, in either one of the first and second methods, the first valve circumferentially surrounds the second valve.

Optionally, in either one of the first and second methods, the first valve comprises the umbrella check valve.

Optionally, in either one of the first and second methods, the other of the first and second valves comprises one of a diaphragm check valve, a ball check valve, a swing check valve, a duckbill check valve, and an umbrella check valve.

Optionally, in either one of the first and second methods, the unitary component is formed of a resilient material, such as an elastomeric material, such as an elastomer, a thermoplastic elastomer, or styrene-ethylene/butylene-styrene.

Optionally, either one of the first and second methods comprises attaching a diaphragm to the body to define a chamber between the diaphragm, the body and the unitary component.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
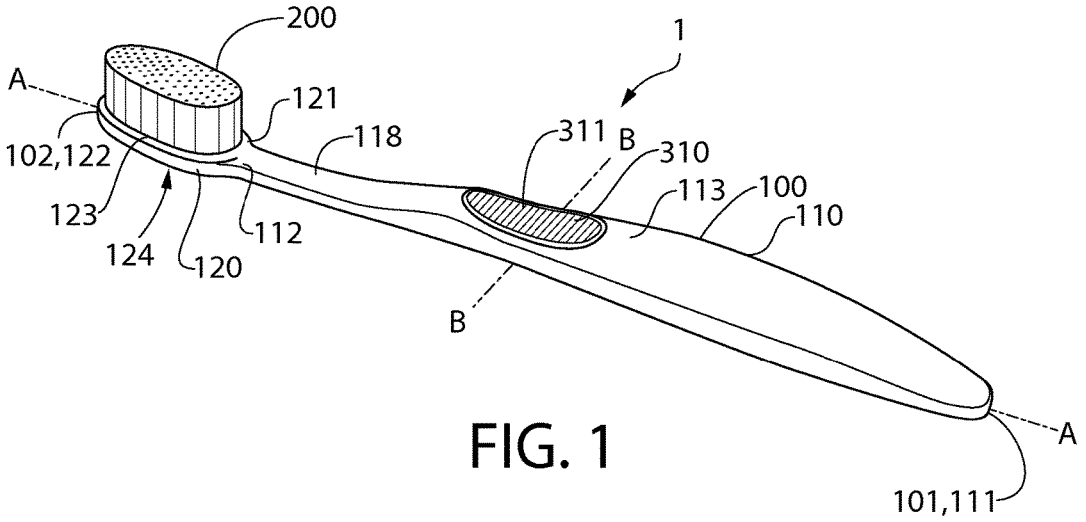
FIG. 1 shows a perspective view of an oral care implement according to an exemplary embodiment of the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the following description, each of the exemplary embodiments of the oral care implement of the invention comprises a manually-operated oral care implement, more specifically a manually-operated toothbrush. However, in variations to these embodiments, the oral care implement could instead comprise a powered oral care implement, such as a powered toothbrush, wherein one or more oral care elements provided to the head of the implement are drivable so as to be moved relative to the handle of the implement. In still further embodiments, the oral care implement could instead comprise other forms of oral care implement, such as a soft-tissue cleaner, a tooth polisher, an interdental brush, a tongue scraper, or another implement designed for oral care. It is to be understood that other embodiments may be utilised, and that structural and functional modifications may be made without departing from the scope of the present invention.

FIGS. 1 to 5 illustrate an oral care implement, in this case a toothbrush, according to an exemplary embodiment of the present invention, generally designated with the reference numeral 1. As viewed from the exterior, the toothbrush 1 generally comprises a body 100, oral care elements 200 and a fluid outlet 125 on a head 120 of the body 100, and a user-operable actuator 310 of a pump 300 on a handle 110 of the body 100.

The body 100 of the toothbrush 1 has a proximal end 101 and a distal end 102 and is elongate between the proximal and distal ends 101, 102. The body 100 comprises the handle 110 and the head 120 at a distal end 112 of the handle 110. The head 120 is a distal portion of the body 100 and has a proximal end 121 and a distal end 122, which distal end 122 forms the distal end 102 of the body 100. The head 120 has extending therefrom the oral care elements 200 for cleaning or polishing surfaces in a user's mouth, such as surfaces of their teeth.

The oral care elements 200 extend from a first, front side of the toothbrush 1, more specifically from a first, front side 123 of the head 120, and are for cleaning or polishing surfaces in a user's mouth, such as surfaces of their teeth. As used herein, the term "oral care element" is used in a generic sense to refer to any structure that can be used to clean, massage or polish an oral surface, such as teeth or soft tissue, through relative surface contact. In this embodiment, the oral care elements comprise a plurality of tooth cleaning elements, preferably a plurality of flexible bristles arranged in tufts. However, in variations to this embodiment, the oral care elements may additionally or alternatively comprise one or more tooth polishing elements, preferably in the form of elastomeric tooth polishing elements, such as elastomeric protrusions, elements, fingers, or prophylactic (prophy) cups. In some embodiments, the oral care elements 200 may comprise at least one of any one or more of the following, without limitation: bristles, rigid bristles, flexible bristles, filament bristles, fibre bristles, nylon bristles, polybutylene terephthalate (PBT) bristles, tapered bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations.

The head 120 also comprises the fluid outlet 125 at the first, front side 123 of the head 120. The fluid outlet 125 will be described in more detail below.

In a variation to the illustrated embodiment, a soft tissue cleaner may be provided on a second side of the toothbrush 1, such as a second, rear side of the toothbrush 1 opposite to the front side of the toothbrush 1. Such a soft tissue cleaner may be provided on a second, rear side 124 of the head 120.

The handle 110 is a proximal portion of the body 100 and has the distal end 112 and a proximal end 111, which proximal end 111 forms the proximal end 101 of the body 100. The handle 110 includes a neck portion 118 by which the handle 110 is connected with the head 120. The neck portion 118 is generally of a smaller cross sectional area than the rest of the handle 110. The neck portion 118 includes the distal end 112 of the handle 110, which is that portion of the handle 110 fixed to and closest to the proximal end 121 of the head 120. In the illustrated embodiment, the head 120 is non-detachable from the handle 110. However, in variations to the illustrated embodiment, the head 120 may be detachable from the handle 110, such as for replacement of the head 110 when the oral care elements 200 become worn.

The handle 110 provides a user with a mechanism by which he/she can readily grip and manipulate the toothbrush 1, includes ergonomic features which provide a high degree of control for the user while maintaining comfort, and may be formed of many different shapes and with a variety of constructions. Although the handle 110 is a non-linear structure in the illustrated embodiment, the invention is not so limited, and in certain embodiments the toothbrush 1 may have a simple linear handle 110.

Figure 2:
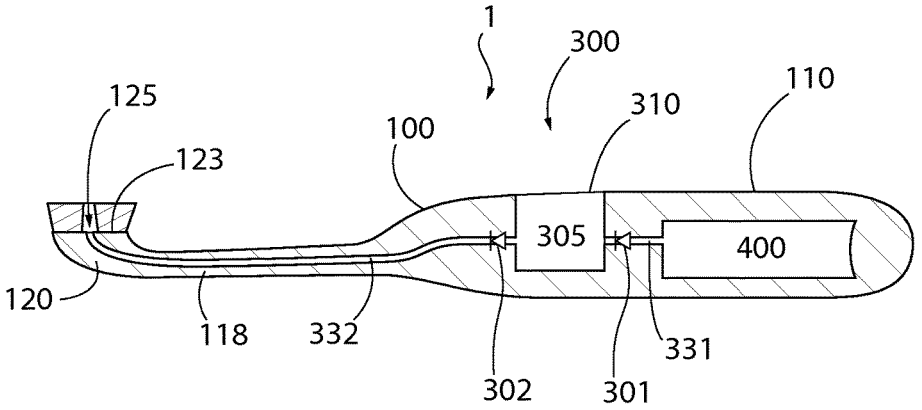
FIG. 2 shows a schematic diagram of the oral care implement of FIG. 1.
Figure 3:
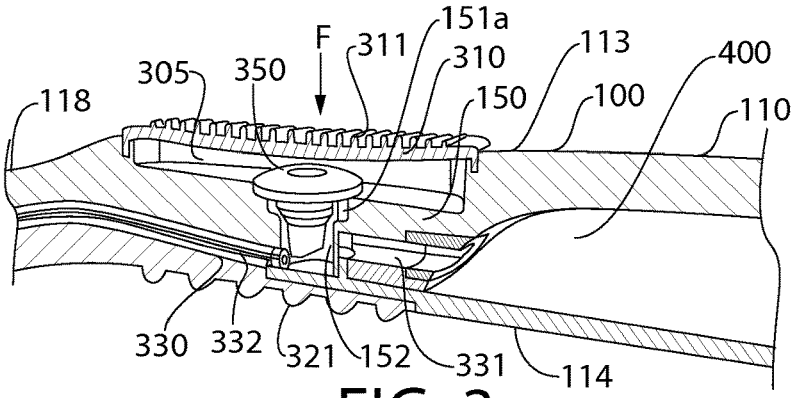
FIG. 3 shows a partial perspective cross-section of the oral care implement of FIG. 1.
Figure 4:
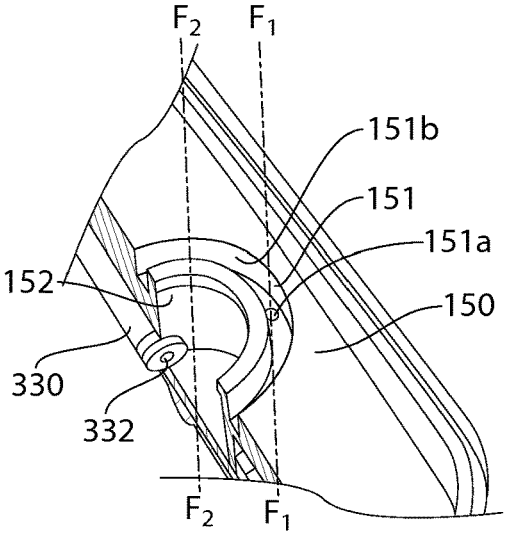
FIG. 4 shows the partial perspective cross-section of FIG. 3 from a different angle.

As best shown in FIGS. 2 and 3, the toothbrush 1 comprises a reservoir 400 in the handle 110 of the body 100. In the illustrated embodiment, the reservoir 400 is comprised in a vessel formed from a plastic, such as a thermoplastic polymer, e.g. polyethylene terephthalate (PET) or polypropylene (PP), is housed inside the body 100 of the toothbrush 1, and is not visible from the exterior of the toothbrush 1. However, in variations to the illustrated embodiment, the reservoir 400 is made of transparent or translucent material and one or more windows are provided in the body 100, so that the reservoir 400 and its contents are visible from the exterior of the toothbrush 1. In further embodiments, the body 100 comprises the reservoir 400 and the reservoir 400 forms at least part of the handle 110. In some embodiments, the reservoir 400 is detachably connected to the body 100 and may be replaceable or disposable.

Preferably, the oral care fluid comprises one or more oral care agents. Any suitable oral care agent(s) can be used in the present invention. In the illustrated embodiment, the oral care fluid is a mouthwash comprising one or more antibacterial agents, flavors or flavor ingredients, and breath freshening ingredients. However, in variations to the illustrated embodiment, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In some embodiments, the oral care fluid comprises more than one of the oral care agents listed in the preceding sentence. The oral care fluid preferably is free of (i.e., is not) toothpaste. Preferably, the oral care fluid is intended to provide supplemental oral care benefits in addition to merely brushing one's teeth.

As best shown in FIGS. 2 to 5, the toothbrush 1 also comprises the pump 300 in the body 100. The pump 300 is for pumping the oral care fluid from the reservoir 400 in the handle 110 to the fluid outlet 125 of the head 120. The pump 300 comprises a first check valve 301, a second check valve 302 downstream from the first check valve 301, and a chamber 305 of variable volume between the first and second check valves 301, 302. That is, the first check valve 301 is downstream of the reservoir 400 and upstream of the chamber 305, the chamber 305 is downstream of the first check valve 301 and upstream of the second check valve 302, and the second check valve 302 is downstream of the chamber 305.

The reservoir 400 is fluidly connected to the first check valve 301 by a first passageway 331, and the second check valve 302 is fluidly connected to the fluid outlet 125 by a second passageway 332. In the illustrated embodiment, the first passageway 331 is defined by material of the body 100. In variations to the illustrated embodiment, some or a majority of the first passageway 331 may be defined by a separate tube that extends through the body 100. Also, in the illustrated embodiment, a majority of the second passageway 332 is defined by a, preferably flexible, tube 330 that extends through the neck portion 118 of the body 100. In variations to the illustrated embodiment, some or a majority of the second passageway 332 may be defined by material of the body 100.

The fluid outlet 125 may be of any form known in the art. The fluid outlet 125 may permanently permit fluid communication from the exterior of the toothbrush 1 to the second passageway 332, or the fluid outlet 125 may comprise a valve, such as a check valve, that permits fluid flow from the second passageway 332 to the exterior of the toothbrush 1 and restricts or prevents fluid flow from the exterior of the toothbrush 1 to the second passageway 332. Optionally, the fluid outlet 125 includes a spray or atomizer nozzle for causing the oral care fluid to be emitted as one of a spray, a mist, and a stream. Such a nozzle optionally causes the oral care fluid to be emitted in the form of droplets having an average diameter of less than 500 microns, or less than 400 microns, or less than 300 microns, or less than 200 microns, or less than 150 microns.

The body 100 comprises a base 150 at the interior of the handle 110. The chamber 305 is partially defined by a first side of the base 150. Moreover, a first hole 151 extends through the base 150 to fluidly connect the first passageway 331 with the chamber 305, and a second hole 152 extends through the base 150 to fluidly connect the chamber 305 with the second passageway 332. More specifically, the first hole 151 has a first portion **151*a* extending from the first passageway 331, and an annular portion 151*b* fluidly connecting the first portion 151*a* with the chamber 305. The annular portion 151*b* of the first hole 151 circumferentially surrounds the second hole 152. The first portion 151*a* of the first hole 151 extends through the base 150 along a first flow axis $F_1$ that is substantially perpendicular to both longitudinal and lateral axes A-A, B-B of the toothbrush 1. Similarly, the second hole 152 extends through the base 150 along a second flow axis $F_2$ that is substantially perpendicular to both longitudinal and lateral axes A-A, B-B of the toothbrush 1. The second flow axis $F_2$ is parallel to the first flow axis $F_1$. In variations to the illustrated embodiment, one or each of the first and second flow axes $F_1$, $F_2$ may be at any angle between 45 and 90 degrees to the longitudinal axis A-A of the toothbrush 1. In variations to the illustrated embodiment, one or each of the first and second flow axes $F_1$, $F_2$ may be at any angle between 45 and 90 degrees to the lateral axis B-B of the toothbrush 1. The first check valve 301 selectively blocks the first hole 151, and the second check valve 302 selectively blocks the second hole 152, in dependence on a user's operation of the pump 300**, as will be described below.

Figure 5:
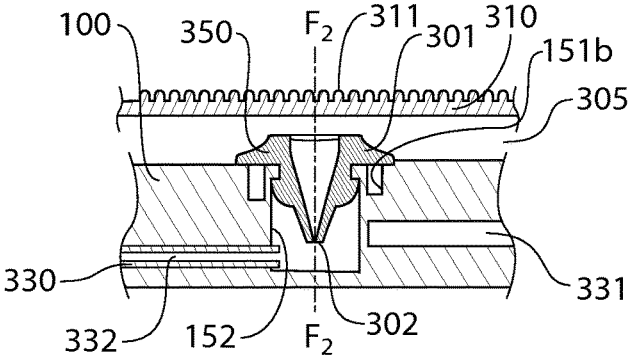
FIG. 5 shows a partial cross-section of the oral care implement of FIG. 1.

As will be best appreciated from consideration of FIGS. 3 and 5, the pump 300 comprises a unitary component 350 comprising both the first and second check valves 301, 302. That is, the first check valve 301 is unitary with, i.e. is formed integrally with, the second check valve 302. In this embodiment, the unitary component 350 is an elastomeric component. That is, the unitary component 350 is formed of an elastomeric material. In this embodiment, the unitary component 350 is formed of a thermoplastic elastomer (TPE). In variations to the illustrated embodiment, the unitary component 350 may be formed of a resilient material, such as an elastomeric material, such as an elastomer, a thermoplastic elastomer (TPE), or styrene-ethylene/butylene-styrene (SEBS).

The unitary component 350 is configured so that the second check valve 302 comprises a duckbill check valve 302, and the first check valve 301 comprises an annular umbrella check valve 301, which umbrella check valve 301 circumferentially surrounds the second check valve 302. The umbrella check valve 301 comprises an annular convex diaphragm, which selectively covers and blocks the annular portion 151*b* of the first hole 151 through the base 150. The annular convex diaphragm of the umbrella check valve 301 is connected to the duckbill check valve 302 fully around a circumference of the duckbill check valve 302. The duckbill check valve 302 is located in the second hole 152 through the base 150, and selectively blocks the second hole 152 through the base 150. The umbrella check valve 301 permits fluid flow from the first passageway 331 to the chamber 305, and prevents or restricts fluid flow from the chamber to the first passageway 331. On the other hand, the duckbill check valve 302 permits fluid flow from the chamber 305 to the second passageway 332, and prevents or restricts fluid flow from the second passageway 332 to the chamber 305. When both of the first and second check valves 301, 302 are closed, the chamber 305 is isolated from each of the first and second passageways 331, 332.

The pump 300 comprises a diaphragm pump. As mentioned above, the chamber 305 is of variable volume, and a wall of the chamber 305 comprises a resilient movable diaphragm 310 of the diaphragm pump. The movable diaphragm 310 acts as a user-operable actuator 310 for a user to operate the pump 300 to pump oral care fluid from the reservoir 400 to the fluid outlet 125. In the illustrated embodiment, the toothbrush 1 comprises a thumb grip surface 311 on the first, front side of the toothbrush 1, more specifically on a first, front side 113 of the handle 110, and the thumb grip surface 311 is unitary with the resilient movable diaphragm 310. On a second, rear side of the toothbrush 1, more specifically on a second, rear side 114 of the handle 110, the toothbrush 1 comprises a second grip surface 321. During use of the toothbrush 1, a user most comfortably holds the toothbrush 1 with the handle 110 lying in the palm of their hand, with their thumb on the thumb grip surface 311, and with their index and/or middle finger on the second grip surface 321.

Operation of the illustrated toothbrush 1 will now be described. Preferably, a user applies a dentifrice to the oral care elements 200 and then uses the dentifrice and the oral care elements 200 to brush their teeth. In order to benefit from the effects of the oral care fluid in the reservoir 400, before, during or after brushing their teeth, while holding the head 120 in their oral cavity, the user applies a force F (see FIG. 3) onto the thumb grip surface 311 in a direction substantially towards the longitudinal axis A-A of the toothbrush 1. Application of the force F causes the diaphragm 310 to move towards the base 150 of the body 110, thereby to reduce the volume of the chamber 305. The reduction in volume of the chamber 305 increases pressure of fluid in the chamber 305. As will be appreciated by the skilled person, the increased pressure of the fluid in the chamber 305 causes the fluid in the chamber 305 to apply a force to the second check valve 302 to overcome the resilience of the second check valve 302. The second check valve 302 thus opens, and the fluid in the chamber 305 passes through the second check valve 302 into the second passageway 332. Meanwhile, the first check valve 301 remains closed, because the pressure in the chamber 305 is greater than that in the first passageway 331. The second check valve 302 remains open until the pressure in the chamber 305 and the pressure in the second passageway 332 are substantially equal, at which point the second check valve 302 closes.

When the user subsequently reduces or removes the force F, the resilience of the diaphragm 310 causes the diaphragm 310 to move away from the base 150, thereby to increase the volume of the chamber 305 and correspondingly reduce the pressure of fluid in the chamber 305. Initially, during this movement of the diaphragm 310 away from the base 150, both the first and second check valves 301, 302 are closed. However, once the pressure of fluid in the chamber 305 drops to below the pressure of fluid in the first passageway 331, the higher pressure of the fluid in the first passageway 331 causes the fluid in the first passageway 331 to apply a force to the first check valve 301 to overcome the resilience of the first check valve 301. The first check valve 301 thus opens, and the fluid in the first passageway 331, comprising oral care fluid from the reservoir 400, passes through the first check valve 301 into the chamber 305. Meanwhile, the second check valve 302 remains closed, because the pressure in the second passageway 332 is greater than that in the chamber 305. Once the pressure in the chamber 305 and the pressure in the first passageway 331 are substantially equal, the resilience of the first check valve 301 causes the first check valve 301 to close. As will be understood by the skilled person, by reapplying the force F, the oral care fluid now in the chamber 305 passes through the second check valve 302. Repeated application and removal of the force F causes a net movement of the oral care fluid from the reservoir 400 to the fluid outlet 125 and the exterior of the toothbrush 1.

Given the limited number of moving parts of the pump 300, and given the compact nature of the components of the pump 300, and specifically the unitary component 350, the oral care implement 1 has a simple, robust and compact pump 300 for pumping the oral care fluid to the fluid outlet 125, and the implement 1 is reusable multiple times to apply the oral care fluid to an oral cavity.

The illustrated toothbrush 1 is relatively simple to manufacture. After forming or otherwise providing the body 100 comprising the base 150 having the first and second holes 151, 152 extending therethrough, the unitary component 350 is fitted (preferably by press-fitting), via the space that will subsequently form the chamber 305, to the base 150 at a position at which the first valve 301 blocks the first hole 151 and the second valve 302 blocks the second hole 152. Specifically, the second valve 302 is press-fitted in the second hole 152 at a position at which the first valve 301 blocks the first hole 151 and the second valve 302 blocks the second hole 152. Once the unitary component 350 is so fitted, the umbrella check valve 301 circumferentially surrounds the duckbill valve 302. Subsequently, the movable diaphragm 310 is attached to the body 100, so that the chamber 305 becomes defined by and between the movable diaphragm 310, the body 100 and the unitary component 350. Since the first and second valves 301, 302 are assembled with the base 150 in a single step, the method of manufacture of the toothbrush 1 is simplified, as compared to other methods in which valves are individually assembled with a base.

In variations to the illustrated embodiments, one or each of the first and second valves may not be a check valve. However, preferably each of the first and second valves comprises a check valve. In variations to the illustrated embodiments, the first check valve may be any one of a diaphragm check valve, a ball check valve, a swing check valve, and a duckbill check valve. In variations to the illustrated embodiments, the second check valve may be any one of a diaphragm check valve, a ball check valve, a swing check valve, and a duckbill check valve.

The reservoir 400 may take any known form. For example, the reservoir 400 may be comprised in a collapsible vessel, such as a collapsible bag or bellows in the body 100, in which case the body 100 preferably includes a vent fluidly connecting an exterior of the collapsible vessel to the exterior of the toothbrush 1, or the reservoir 400 may be comprised in a vessel including a piston separating the oral care fluid from a vented side of the piston.

In variations to the illustrated embodiments, the reservoir 400 may be provided elsewhere in the body 100 than at the position shown in the Figures. For example, the reservoir 400 may be provided in or adjacent to the neck portion 118 of the handle 110, or in the head 120 of the body 100. In some variations to the illustrated embodiment, the reservoir 400 may extend into both the handle 110 and the head 120 of the body 100.

What is claimed is:

1. An oral care implement, comprising:

a body comprising a handle, a head at an end of the handle, and at least one fluid outlet, and a base, the base comprising a first hole and a second hole, the first hole comprising a first portion and an annular portion, and the head having at least one oral care element extending therefrom;

a reservoir in the body and for storing an oral care fluid; and a pump in the body for pumping the oral care fluid from the reservoir towards the fluid outlet, wherein the pump comprises a first valve downstream of the reservoir, a second valve downstream of the first valve and upstream of the fluid outlet, and one of the first and second valves circumferentially surrounds the other of the first and second valves;

wherein the annular portion of the first hole circumferentially surrounds the second hole.

2. The oral care implement of claim 1, wherein the first valve comprises an umbrella check valve.

3. The oral care implement of claim 2, wherein the second valve comprises a duckbill check valve.

4. The oral care implement of claim 1, wherein each of the first and second valves comprises a check valve.

5. The oral care implement of claim 1, further comprising a base having first and second holes extending therethrough along respective flow axes, wherein each of the flow axes is at between 45 and 90 degrees to a longitudinal axis of the oral care implement, and wherein each of the first and second valves selectively blocks a respective one of the first and second holes; wherein each of the flow axes is substantially perpendicular to the longitudinal axis of the oral care implement.

6. The oral care implement of claim 5, wherein each of the flow axes is substantially perpendicular to a lateral axis of the oral care implement.

7. The oral care implement of claim 1, wherein the pump comprises a unitary component comprising the first and second valves.

8. The oral care implement of claim 1, wherein the pump comprises a chamber of variable volume downstream of the first valve and upstream of the second valve.

9. The oral care implement of claim 1, wherein the pump comprises a diaphragm pump, and further comprising a thumb grip surface on the handle, wherein the thumb grip surface is unitary with a movable diaphragm of the diaphragm pump.

10. The oral care implement of claim 1, wherein the reservoir is comprised in the body and forms the handle.

11. The oral care implement of claim 1, wherein the reservoir is detachably connected to the body.

12. The oral care implement of claim 1, wherein the reservoir is transparent or translucent.

13. The oral care implement of claim 1, wherein the oral care implement comprises a toothbrush.

14. A method of manufacturing an oral care implement having a pump, the method comprising:

providing a body comprising a base having first and second holes extending therethrough, the first hole having a first portion and a second portion; and fitting to the body a unitary component comprising first and second valves at a position at which the first valve blocks the first hole and the second valve blocks the second hole, wherein one of the first and second valves circumferentially surrounds the other of the first and second valves;

wherein the second portion of the first hole circumferentially surrounds the second hole.

15. The method of claim 14, wherein one of the first and second valves comprises an umbrella check valve.

16. The method of claim 14, wherein the fitting comprises press-fitting the unitary component to the body and press-fitting the second valve in the second hole at a position at which the first valve blocks the first hole and the second valve blocks the second hole.

17. The method of claim 14, wherein the first valve circumferentially surrounds the second valve.

18. The method of claim 14, wherein the first valve comprises an umbrella check valve and the second valve comprises a duckbill check valve.

19. The method of claim 14, wherein the unitary component is formed of a resilient material, the resilient material being styrene-ethylene/butylene-styrene.

20. The method of claim 14, comprising attaching a diaphragm to the body to define a chamber between the diaphragm, the body and the unitary component.

* * * * *